US007100507B1

(12) United States Patent
Rochon et al.

(10) Patent No.: US 7,100,507 B1
(45) **Date of Patent: *Sep. 5, 2006**

(54) FLEXOGRAPHIC ROTARY PLATEN PRINTING PRESS

(75) Inventors: Gregory P. Rochon, York, PA (US); Wayne F. Fickes, York, PA (US); Thomas Glatfelter, Dover, PA (US)

(73) Assignee: Greydon, Inc., York, PA (US)

( * ) Notice: Subject to any disclaimer, the term of this patent is extended or adjusted under 35 U.S.C. 154(b) by 4 days.

This patent is subject to a terminal disclaimer.

(21) Appl. No.: 11/023,248

(22) Filed: Dec. 27, 2004

Related U.S. Application Data

(60) Continuation of application No. 10/662,677, filed on Sep. 15, 2003, now Pat. No. 6,834,588, which is a division of application No. 09/707,049, filed on Nov. 6, 2000, now Pat. No. 6,644,185.

(51) Int. Cl.
*B41F 33/00* (2006.01)

(52) U.S. Cl. ..... 101/483; 101/216

(58) Field of Classification Search ..... 101/219, 101/216, 349.1, 327–329, 146, 141, 158, 101/153, 196, 193, 199, 214, 253, 256, 269, 101/282, 287, 288, 483
See application file for complete search history.

(56) References Cited

U.S. PATENT DOCUMENTS

| | | | | |
|---|---|---|---|---|
| 469,747 | A | 3/1892 | Morgan | |
| 2,603,153 | A | 7/1952 | Warren et al. | |
| 3,138,098 | A | 6/1964 | Worth | |
| 3,260,193 | A | 7/1966 | Mann | |
| 3,270,347 | A | 8/1966 | Wilde | |
| 3,373,684 | A | 3/1968 | Fisher | |
| 3,537,393 | A | 11/1970 | Hegi | |
| 3,827,356 | A | 8/1974 | Snow et al. | |
| 3,934,506 | A | 1/1976 | Levy et al. | |
| 4,023,482 | A * | 5/1977 | Swett et al. | 101/19 |
| 4,057,013 | A | 11/1977 | Asano | |
| 4,443,123 | A * | 4/1984 | Ono et al. | 400/145.2 |
| 4,514,819 | A | 4/1985 | Punater et al. | |
| 4,566,387 | A | 1/1986 | Marozzi | |
| 4,787,313 | A | 11/1988 | Osborn et al. | |
| 5,224,422 | A | 7/1993 | Marozzi et al. | |
| 5,341,739 | A | 8/1994 | Rogge | |
| 5,355,798 | A | 10/1994 | Yoder, Jr. | |

(Continued)

*Primary Examiner*—Anthony H. Nguyen
(74) *Attorney, Agent, or Firm*—Gibbons, Del Deo, Dolan, Griffinger & Vecchione

(57) ABSTRACT

A flexographic rotary platen printing press for printing indicia on a web of flexible material moving along a longitudinal axis. The flexographic rotary platen printing press includes a print drum assembly that is affixed to a trolley that is moveable in a linear direction across the web generally transverse to the direction of the web movement. When the web is stopped, the print drum is caused to roll across the web that is sandwiched between the print drum and a flat, planar platen to print indicia onto the web in a line contact. A linear drive system causes the movement of the print drum assembly. The speed of the transverse movement is electronically coordinated to the speed of the rotation of the print drum as it moves across the web to carry out the printing operation. A multi-color printing process is created by serially positioning two or more flexographic presses without the use of a large number of idler rollers or changes of direction in the path of the web as it moves from one flexographic printing press to a subsequent flexographic printing press.

8 Claims, 4 Drawing Sheets

U.S. PATENT DOCUMENTS 5,379,697 A 1/1995 Ertl
5,477,783 A * 12/1995 Hashimura ..... 101/158
5,540,148 A 7/1996 Oumiya et al.
5,570,633 A 11/1996 Schultz et al.
5,787,811 A 8/1998 Achelpohl et al.
6,176,181 B1 1/2001 Van Ryzin et al.

* cited by examiner

FLEXOGRAPHIC ROTARY PLATEN PRINTING PRESS

CROSS REFERENCE TO RELATED APPLICATIONS

This application is a continuation of patent application Ser. No. 10/662,677 filed Sep. 15, 2003, now U.S. Pat. No. 6,834,588 B1, issued Dec. 28, 2004, which is a division of U.S. application Ser. No. 09/707,049, filed Nov. 6, 2000, now U.S. Pat. No. 6,644,185 B1, issued Nov. 11, 2003.

BACKGROUND OF THE INVENTION

The present invention relates to a flexographic rotary platen printing press utilized for printing indicia onto a flexible web, and, more particularly, to a flexographic rotary platen press having a printing system that makes the printing process easier and with accurate indexing of multiple printing colors.

The use of various printing presses are, of course, well know for their use in providing the printing of a web of flexible material, such as plastic material used in packaging industry for various products. In such systems for printing and in general, the packaging machine, or host machine, actually pulls the web through the print station and that host machine therefore normally provides the movement of the web as well as the registration to insure that the indicia is printed on to the web at the proper location along that web and that each of that indicia is properly spaced along the web.

One typical system currently used for such purpose is the platen press where the web is positioned on the platen and held motionless while a generally planar printing plate is impressed against that portion of the web, sandwiching the web material between the printing plate and the platen. While that Type of system allows good registration of the indicia to be printed onto the web, there is an inherent fault in that it is extremely difficult to maintain an even print over such as large area, that is, the printing plate must be precisely planar and parallel to the plane of the platen or the eventual printed indicia is uneven, and exhibits a non-uniform pattern.

Another current system is with the use of a flexographic press where the web is continually in motion and is moved along its longitudinal axis by the various mechanisms of the host machine. In that system, there is a rotary print drum that is rotated and the web is moved intermediate that rotating printing drum and a round impression roller as opposed to the flat platen of the previous platen press. The cylindrical rotary print drum has the desired indicia on a printing plate located on the external peripheral surface of that printing drum and rotates in the same direction as the web. An inking system is used to apply the ink to the printing roller and that inking system is well know and uses a anilox roller to apply the ink to the particular indicia on the print drum.

Again, however, the aforedescribed system has certain limitations as the moving web must be carefully aligned with the platen and the printing roller and thus is carried through a large number of idler rollers that guide the web to the proper position for printing, including an impression roller that requires the web to form a complete S configuration for correct alignment, registration and for providing the proper tension at all times on the moving web.

Thus, with the moving web type of printing press, the system requires a large number of tensioning and idler rollers to hold the web in the correct alignment and to create the proper tension in the web as it moves in a serpentine fashion through the flexographic printing press. Each roller, therefore, changes the direction of the web as it is moving through the printing press and each roller and change of direction also induces a stress on the web and can cause a stretching of the web and result in the final printed indicia being blurred. Accordingly, while the use of a multiplicity of tensioning and other rollers is necessary in the operation of the aforedescribed press to carry out printing on the fly, there is also a downside, that is, while the rollers are essential in the overall control of the web tension and control of the web orientation, the use of so many rollers generally creates many changes in direction of the web and also introduces stresses in the web that are undesirable.

The problem is aggravated with the use of multicolor printing where different colors are used since those different colors are printed on to the web serially, that is, after the printing of one color on to the web, the web, still moving at a high speed, progresses to a further printing cycle where the next color is applied to the web and so on. Obviously then, with a multi color printing, there are two, three of additional sets of rollers through which the web must travel and, again, each additional set of rollers can cause stress, stretch the web and make the registration of the subsequent colors extremely difficult. Too, with the multiple color printing presses, there is no room to insert dryers intermediate the color printing steps and thus the system is limited to materials having some porosity of the web material to allow the ink to dry before passing through a later printing stage with a different color. Accordingly, the use of such a multi-color rotating drum printing press is inappropriate for the other non-porous materials of webs, such as polyethylene, nylon, or polypropylene.

Thus, it would be advantageous to provide a flexographic printing press that can print the desired indicia upon a web without an excess of tensioning rollers or S-bends, be able to be used on non-porous materials and yet achieve a good printing quality and accuracy of the position and registry of the printed material.

BRIEF SUMMARY OF THE INVENTION

The present invention provides an improved flexographic rotary platen printing press and system used by that printing press to print indicia upon a web. With the present printing system, there is provided a system that operates in conjunction with a host machine that advances or moves the web in an intermittent manner, that is, the host machine preferably advances the web along its longitudinal axis and stops the web at predetermined intervals where the actual printing of the web is carried out. The overall movement of the web itself can be carried out by a conventional means including a D.C. or stepper motor in the host machine and controlled to move and stop the progress of the web at a precise location where it is desired to place the printed indicia. Alternatively, the present flexographic rotary platen printing system can be used with some independent moving system that can control the movement of the web and not necessarily be a part of a host machine that is carrying out some other operation on the web material.

With the present invention, however, as will be seen, the actual speed of the advancement of the web is not critical and need not be subject to any particularly precise electronic control since that speed does not need to be coordinated with the speed of any print drum; only the position of the web in the stopped position is of importance.

Thus, the web is stopped in the precise desired position and a print drum, having the print plate carried thereon, is activated and moves transversely across the web as the print drum also rotates. As the print drum moves along the transverse direction, the web is sandwiched between the print drum and a flat platen, such that the printing of the web takes place. When the print drum reaches the end of its travel across the width of the web, the printing is completed and the print drum is returned to its original location to be ready for a subsequent cycle.

As is known, the inking process can also be carried out by conventional inking systems including the use of an anilox roller and the inking system may utilize a closed doctor blade type utilizing a laser engraved ceramic coated anilox roller mounted in a stationary position off to the side of the web and fed with ink by an inverted bottle cartridge of pigmented ink. In the inking system, the anilox roller is driven, preferably by a stepper motor, and that stepper motor is coordinated with a stepper motor that drives the print drum during the inking process such that the two motors are synchronized electronically to assure that the surface speeds of the anilox roller and the print plate on the print drum match without the need to link the two motors or drives together with gears. As will be noted, the various rotating motive means will be described herein with the preferred means, that is by use of stepper motors, however, it will be seen that other motive means, including servo motors, could be used in carrying out the present invention and still be within the inventive concept. Of importance, however, is that with the use of speed controllable motors, the coordination of the speeds between the anilox roller and the print drum can be carried out electronically and thus, without the need for any gearing system to provide that coordination of such speeds.

Thus, the print drum is also driven by a stepper motor and the motor speed can be controlled as the print drum moves transversely across the web in carrying out the printing process. A further stepper motor operates the linear drive system utilized to move the print drum in the transverse direction and that linear drive system can comprise mounting the print drum, its bearing housing and its stepper motor on a trolley that slides along a pair of rails. A belt or sprocketed chain can connect the linear drive motor to the trolley and by operation of the linear drive motor, the trolley carrying the print drum, the print motor and the print drum bearing housing bi-directionally transverse to the movement of the web, when in motion.

Taking, therefore, a complete cycle for a single color print, the print drum will make one complete revolution to rotate the print plate against the anilox roller to ink the print plate. At this step, the stepper motor rotating the anilox roller and the stepper motor rotating the print drum are electronically controlled to match the speed of the anilox roller with that of the print plate. Once inked, the print drum will disengage from the ink system and move transversely across the web while simultaneously being rotated by its stepper motor.

At this step, the speed of the rotation of the print drum is controlled to be coordinated with the linear speed of the print drum as it moves transversely across the web to print the desired indicia on the web at a precise registration. The web, being sandwiched between the print drum and a flat platen, is therefore at a standstill and the printing process can be carried out accurately and the contact between the printing plate and the flat platen is a line contact. The print drum continues its progress, moved by the linear drive motor, from the first or home position fully across the web to a remote position past the web where its motion is terminated and printing has been accomplished. Upon that completion of the print step, the print drum will lift away from the platen and return to the home position juxtaposed to the inking system ready to carry out the process again.

As such, the entire process for a print cycle can be carried out by means of three stepper motors; an anilox motor to rotate the anilox roller, a linear drive motor to move the print drum in a linear path across the web and a print drum motor that rotates the print drum. All coordination of the motors can be readily be accomplished electronically by a microprocessor based system.

Other features of the present flexographic rotary platen printing press will become apparent in light of the following detailed description of a preferred embodiment thereof and as illustrated in the accompanying drawings.

DETAILED DESCRIPTION OF THE INVENTION

Figure 1:
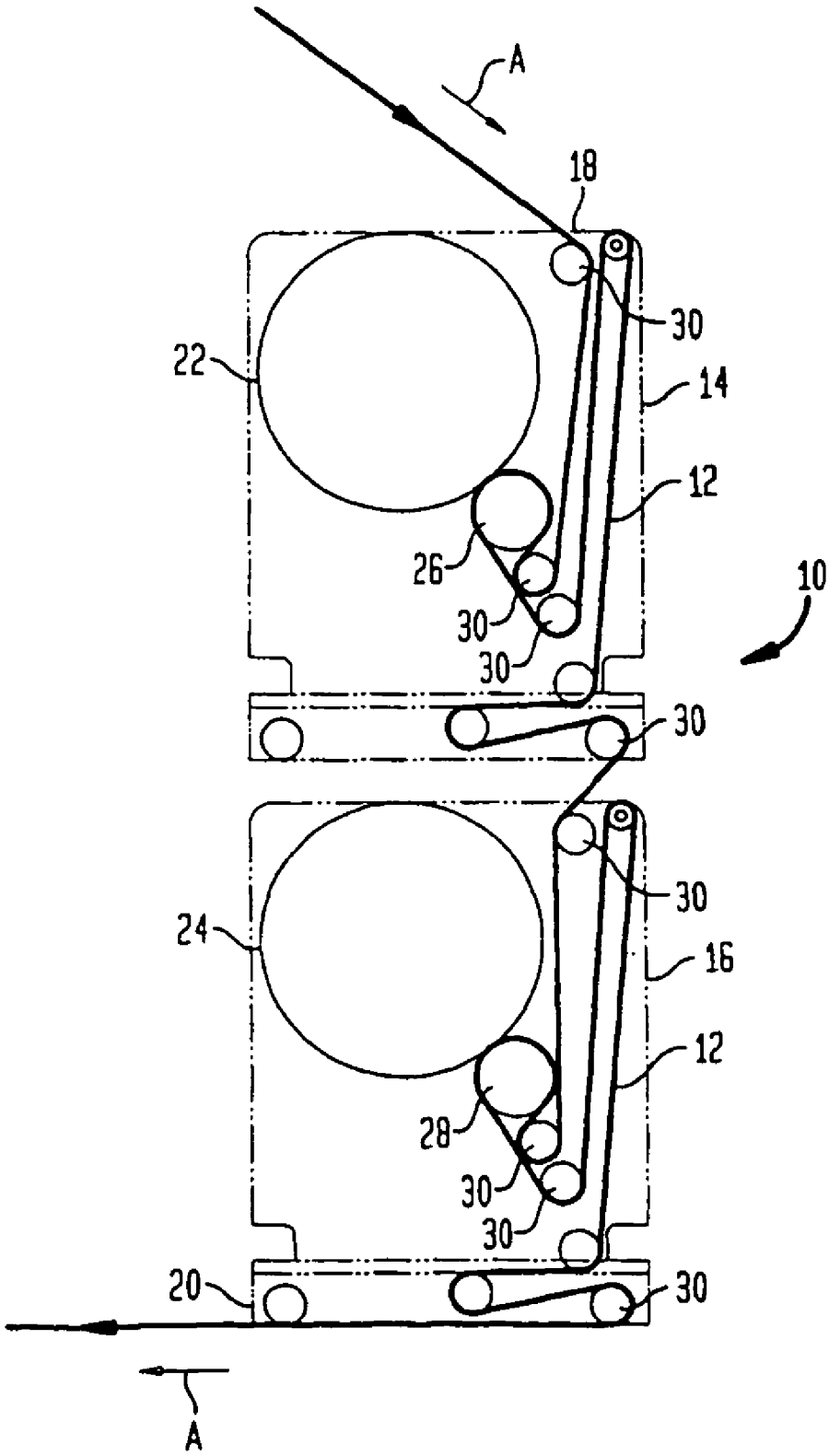
FIG. 1 (PRIOR ART)
FIG. 1 is a schematic of a multi-color flexographic printing press constructed accordance with the present known state of the art.

Referring now to FIG. 1, there is shown a schematic view of a typical prior art flexographic printing press system 10 currently used to carry out the printing of multi-colors onto a web 12 of flexible material. As can be seen, in order to print more than one color, the flexographic printing press system 10, of necessity, requires, basically, separate printing presses, that is, there is a first printing press 14 for printing indicia of one color onto the web 14 and a second printing press 16 to print the second color onto that web 12. Obviously, while the FIG. 1 illustrates a printing system 10 utilizing two colors, there may be additional colors that can be printed on to the web 12 with the consequent equal number of additional printing presses that print those additional colors onto the web 12.

In FIG. 1, however, it can be seen that the web 12 progresses through a serpentine path as it passes from the entrance 18 to the first printing press 14 to the exit 20 of the second printing press 16 traveling in the direction of the arrows A. In particular, each of the first and second printing presses 14, 16 include, respectively a first printing drum 22 and a second printing drum 24 where the indicia is formed on the exterior surface of the first and second drums 22, 24, generally by means of printing plates that are, of course, inked by conventional inking systems (not shown) to apply the differing colors of ink to that exterior surface.

Also, first and second impression rollers 26, 28 are located so as to be in abutment to the first and second print drums 22, 24 to assure the proper contact between the web 12 and the print drums 14, 16 in carrying out the transfer of the ink to the web 12. As is conventional, in order to achieve the proper contact between the web 12 and the print drums 22, 24, the web basically forms an S configuration as it passes around the first and second impression rollers 26, 28. As also can be seen, there are considerable additional idler rollers, 30, that, in general, direct the web 12 into the proper registration and engagement with the first and second printing drums 22, 24 to create the proper, desired tension of that web 12 as well as the pressure of the contact between the first and second impression rollers 26, 28 and the first and second print drums 22, 24.

As stated, however, each turn or twist of the web 12 traveling over a roller can cause stresses to be created in the web 12 and potentially cause a stretching of the web 12 and a consequent misalignment of the printed indicia or a blurring effect of the printed indicia due to that stretching and relaxing of the flexible material of the web 12. Accordingly it would be advantageous to provide a printing press system where multiple colors can be imprinted on to the flexible web while avoiding, as much as possible, the stretching caused by the multiple rollers, that is, to keep the number of idler and other rollers down to a minimum. It should be noted, that while the FIG. 1 printing system is believed to be typical of the number of the various rollers used in a conventional, prior art multi-color printing system and is submitted to be fairly representative, there may be basically more or less rollers user in any particular commercial multi-color printing press. The illustrative FIG. 1 is to indicate that there are a large number of such rollers that are current used in a typical current multi-color printing system.

As a further drawback of the present prior art multi-color flexographic printing system as shown in FIG. 1, it can also be seen the each of the first and second printing presses 14, 16 are aligned together in close proximity to each other as the web is moved serially from the first printing press 14 to the second printing press 16. As such, the lack of available space between the first printing press 14 and the second printing press or presses 16 leaves no room for a dryer to be located intermediate those printing presses or, for that matter, between any subsequent printing presses where additional colors are utilized. Thus, there is insufficient time for the indicia printed on to the web 12 to dry from one printing press to another.

Since it is important for the printed indicia to dry before passing through a subsequent printing press, the printing press system of FIG. 1 is basically limited to web materials where the drying process can take place in as rapid an amount of time as possible and thus, the printing press system 10 of FIG. 1 is not suitable for the use of non-porous web materials such as polyethylene, nylon, or polypropylene or the like and is a limitation on the use of that printing press system.

Figure 2:
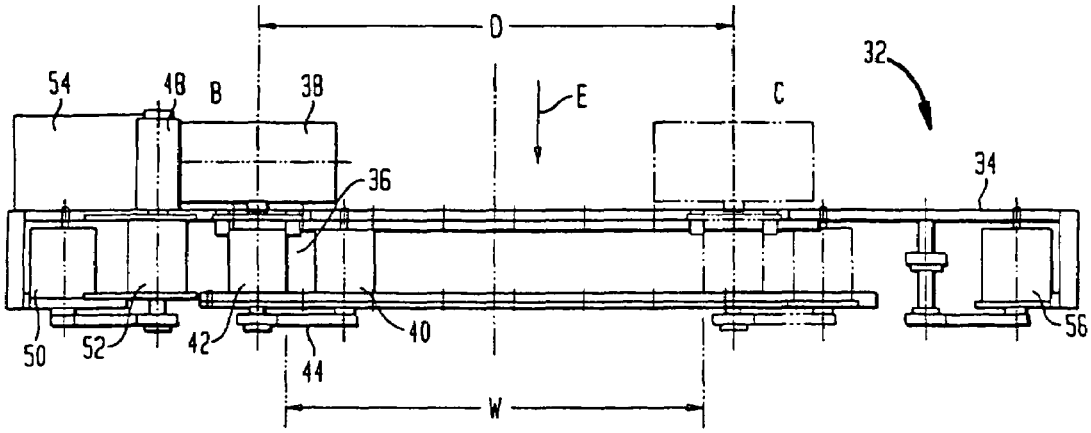
FIG. 2 is a top, plan view of the flexographic rotary platen printing press constructed in accordance with the present invention.
Figure 3:
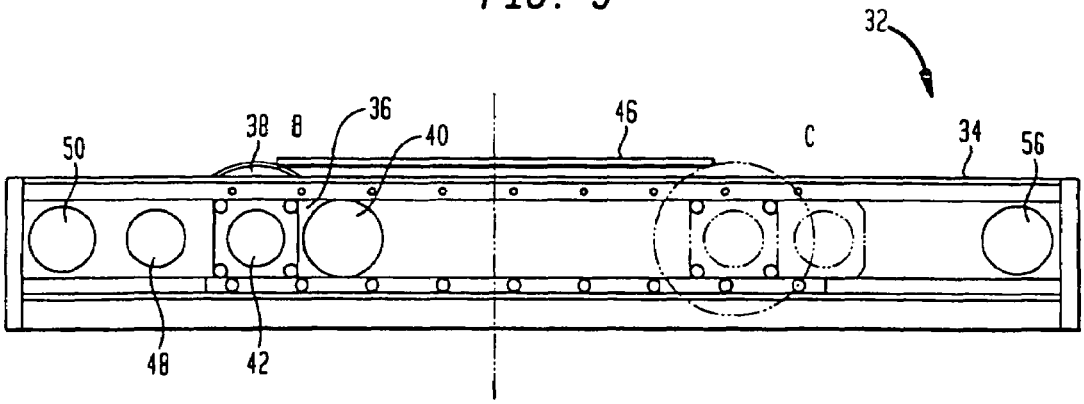
FIG. 3 is a side view of the printing press of FIG. 2.

Turning now to FIGS. 2 and 3, there are shown, respectively, a plan view and a front view of a flexographic rotary platen printing press 32 constructed in accordance with the present invention. As can be seen, the basic flexographic rotary platen printing press 32 comprises a frame 34 upon which the apparatus is constructed. The frame 34 may be any variety of structural members that are assembled together to hold the various components and the apparatus to be hereinafter described and can generally be constructed of steel frame members welded, riveted or bolted together.

The flexographic rotary platen printing press 32 comprises a print drum assembly 36 that includes a print drum 38 and the various components necessary to enable that print drum 38 to be rotated as will later be explained. The print drum assembly 36 thus also includes a print drum motor 40 and a print drum bearing housing 42 that contains and includes the associated gearing to enable the print drum motor 40 to rotate the print drum 38. A belt 44 may be utilized to convey the rotational movement of the print drum motor 40 to the print drum bearing housing 42 and thus to the print drum 38 itself. The indicia to be printed on to the web 12 is normally provided on a cylindrical printing plate that is affixed to the external annular surface of the print drum 38.

As indicated, the print drum motor 40 is preferably a stepper motor or so as to have good control of the rotational movement provided to the print drum 38, however the print drum motor 40 may be a D.C. servo motor or other device that can be fairly precisely controlled with respect to its speed and angular position.

In FIGS. 2 and 3, the print drum assembly 36 is shown in two positions, a first or starting position indicated by the solid line depiction of the print drum assembly, labeled B and a second or ending position showing the print drum assembly 36 in the dotted line depiction and labeled C. As will become clear, the print drum assembly 36 is movable between position B and C to effect the printing process.

As also shown in FIG. 2, the centerline of the print drum 38 moves a distance D as it traverses from its first position at B to its second position at C. As the print drum assembly 36 moves between the points B and C, the print drum assembly 36 traverses across the web 12 that is located as shown and which has a width W. The web travels in the direction of the arrows E. As previously indicated, the positioning and movement of the web 12 is normally effected by the host machine, not shown, in a conventional manner where the web 12 is used for some packaging process carried out by that host machine. Accordingly, that host machine pulls the web 12 through the flexographic printing press 32 in carrying out the present invention and the host machine also provides the necessary controller and associated components to periodically stop the movement of the web 12 as will be explained. Alternatively, however, the present flexographic printing press 32 can have its own means to cause the web 12 to travel as shown in the direction E and to stop at predetermined intermediate positions at precisely registered locations where the printing process can take place.

The web 12, itself, travels in the direction of the arrows E and, as shown in FIG. 3, there is a flat, planar platen 46 positioned so as to sandwich the web 12 between the platen 46 and the print drum 38. Thus, as can be seen in that Figure, as the print drum 38 moves between the position at B to the position at C, the print drum 38 rolls across the undersurface of the web 12 so as to transfer the indicia from the print drum 38 to the web 12, and there is a line contact between the print drum 38 and the web 12 backed up by the flat, planar platen 46. Since the distance D, that is, the distance traveled by the print drum 38 is slightly longer that the width W of the web 12, it can be seen that the line contact between the print drum 38 and the web 12 continues fully across the web 12 to carry out the printing process of the indicia on to the full width of the web 12 and that the print drum 38 continues a slight distance beyond the outer edges of the web 12 and discontinues contact with the web 12.

An inking system is also used to deposit ink on to the printing plate that is affixed onto the external surface of the print drum 38. That inking system may be a conventional system used with flexographic printing presses and includes an anilox roller 48 that contacts the exterior surface of the print drum 38 when the print drum assembly 36 is in that first or starting position at position B. The anilox roller 48 is rotated by means of a anilox motor 50 via an anilox bearing housing 52. As is also conventional, the anilox motor 50 is coordinated in its speed with the speed of the print drum motor 40 so that the surfaces of the anilox roller 48 and print drum 38 are moving at the same speed as they are in contact with each other in depositing the uniform layer of ink onto the indicia to be printed onto the web 12, however, where the conventional speed coordination is carried out by a mechanical gearing system, the present invention includes the use of speed controlled motors, such as stepper or servo motors that allow the coordination to be carried out electronically by means of a microprocessor and without the need for a mechanical gearing system. The ink for the anilox roller 48 can be supplied by a conventional ink supply 54.

Thus, in carrying out the printing of the web 12, as the web 12 is progressed along the longitudinal axis as indicated by the arrow E, the print drum assembly 36, including the print drum 38, travels linearly, generally transverse to that axis of travel of the web 12, and preferably moves in a linear direction along an axis that is 90 degrees displaced from the axis of the movement of the web 12. The actual linear movement of the print drum assembly 36 takes place, of course, when the web 12 has ceased movement.

Figure 4:
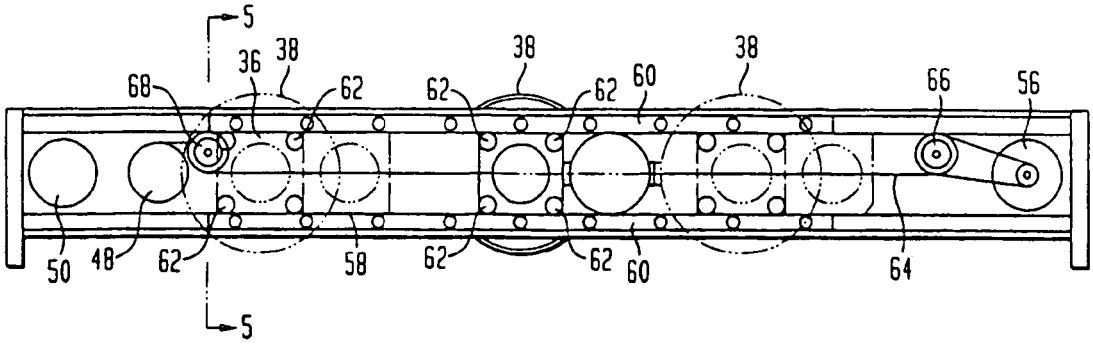
FIG. 4 is a front view of the flexographic rotary platen printing press of the present invention and showing, in more detail, the linear traversing mechanism used to carry out printing process.
Figure 5:
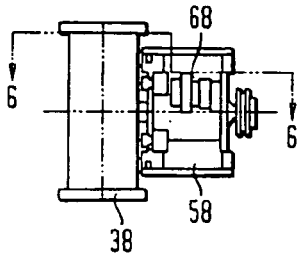
FIG. 5 is an end cross-sectional view of the printing press taken along the line 5—5 of FIG. 4 and illustrating the linear drive system.
Figure 6:
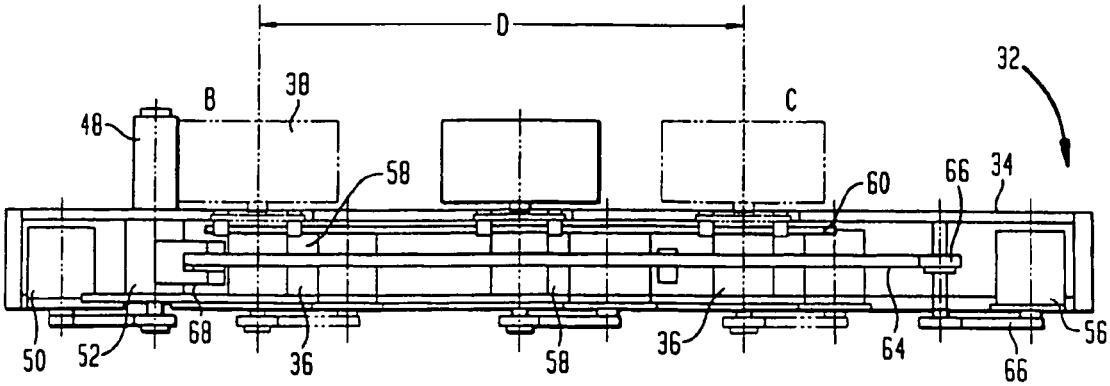
FIG. 6 is a top, cross sectional view of the present invention taken along the line 66- of FIG. 5.

Turning now to FIGS. 4–6, there is shown, respectively, a front view of the present flexographic printing press 10, an end cross sectional view taken along the lines 5—5 of FIG. 4, and an top cross sectional view taken along the lines 6—6 of FIG. 5. In these Figures, the linear drive system is shown that moves the print drum assembly 36 linearly across the web 12 (FIGS. 2–3) in a direction transverse to the normal direction of movement or travel of the web 12. Although the linear drive system to be hereafter explained is the preferred system, it will be seen that any number of alternative systems could be employed to carry out the linear movement of the print drum assembly 36.

The linear drive system comprises a linear drive motor 56 that is rotatable at a controllable speed and, again, a suitable motor for such purpose is a stepper motor, although other motors, such as a servo motor, could be employed as long as the motor speed can be controlled. The print drum assembly 36 is basically carried by a trolley 58 that can move in the desired transverse direction to the movement of the web 12. Trolley 58 can move along two rails 60 that provide support for the trolley 58 and the trolley itself can be affixed to be supported by and move along those rails 60 by a plurality of rollers 62 having V-shaped outer configuration that fit onto the rails 60. As such, the trolley 58, along with the entire print drum assembly can easily ride along a linear path that is generally transverse to the axis of the movement of the web 12.

Further making up the linear drive system, there is a flexible belt 64 that is affixed to a sprocket 66 on the linear drive motor 56 and which flexible belt 64 is also affixed to a idler sprocket 68 at the far end of the rails 60 remote from the linear drive motor 56. The flexible belt 64 is also affixed to the trolley 58 such that by rotating or activation of the linear drive motor 56, the flexible belt 64 can move to displace the trolley 58 along its linear path. Accordingly by activating the linear drive motor 56, the trolley 56 carrying the print drive assembly 36 can be moved along the linear path in both directions generally transverse to the movement of the web 12.

It should be noted, as a feature of the present invention, that the print drum 38 progress along the linear path across the web 12 to carry out the printing of indicia on that web 12, the speed of the transverse linear motion is coordinated with the speed of the rotation of the print drum 38 to lay the printing indicia down onto the web 12 without smearing. In the preferred embodiment, that coordination can be carried out by the use of stepper motors for both the linear drive motor 56 and the print drum motor 40 and both motor speeds controlled by a microprocessor. Alternatively, of course, servo motors could be used or other rotative devices that can be electronically controlled with respect to their speed. Thus, as can be seen, all of the motor speeds, including the print drum motor 40, the anilox motor 50 and the linear drive motor 56 are all speed controllable and all can be coordinated by means of an electronic function utilizing a microprocessor.

With the foregoing apparatus, the method of carrying out the printing of indicia onto the web 12 can now be readily explained by reference to FIGS. 2–6. The web 12 is caused to move along a longitudinal axis generally in the direction of the arrow E. That movement is conventionally carried out by a host machine that provides some further function on the printed web such as a packaging machine and the host packaging machine is programmed to pull web through the flexographic printing press 32 as well as to start and stop the movement of the web 12 at predetermined times and registry locations. All of such control of the web movement is generally standard in the industry, however, as an alternative, the conventional equipment used to carry out such movement and the coordination of the starting and stopping of the web and the registry of the web in a predetermined position may be provided by dedicated or stand alone equipment provided along with the flexographic printing press and not depend upon that function by the host machine.

In any event, while in the position B, the print drum 38, having the printing plate affixed thereto, is inked by a coordination of the anilox roller 48 rotating in synchronous motion with the print drum 38 to apply the proper amount of ink to the indicia formed on the printing plate. The movement of the web 12 along a longitudinal axis E is halted such that the web 12 is motionless and in proper registry as determined by the host machine or other apparatus. The linear drive motor 56 is activated to move the flexible belt 64 to thus move the trolley 58 carrying the print drum assembly 36 across the web 12 in a direction generally transverse to the direction of the normal web movement.

As the print drum assembly 36 moves linearly in the transverse direction, the print drum motor 40 rotates the print drum 38 at a speed coordinated with the linear motion of the print drum 38 to lay down the printed indicia onto the web 12. When the print drum 38 has concluded its linear travel, and the print drum assembly 36 is at the location C, the printing of the indicia has been completed and the linear drive system can be utilized to return the print drum assembly 36 back to the position B or the starting position to be ready for the next printing progression. Thus, the host machine can commence the movement of the web 12 in the longitudinal axis in the direction of the arrows E to reposition and re-register the web 12 for the next printing cycle.

Figure 7:
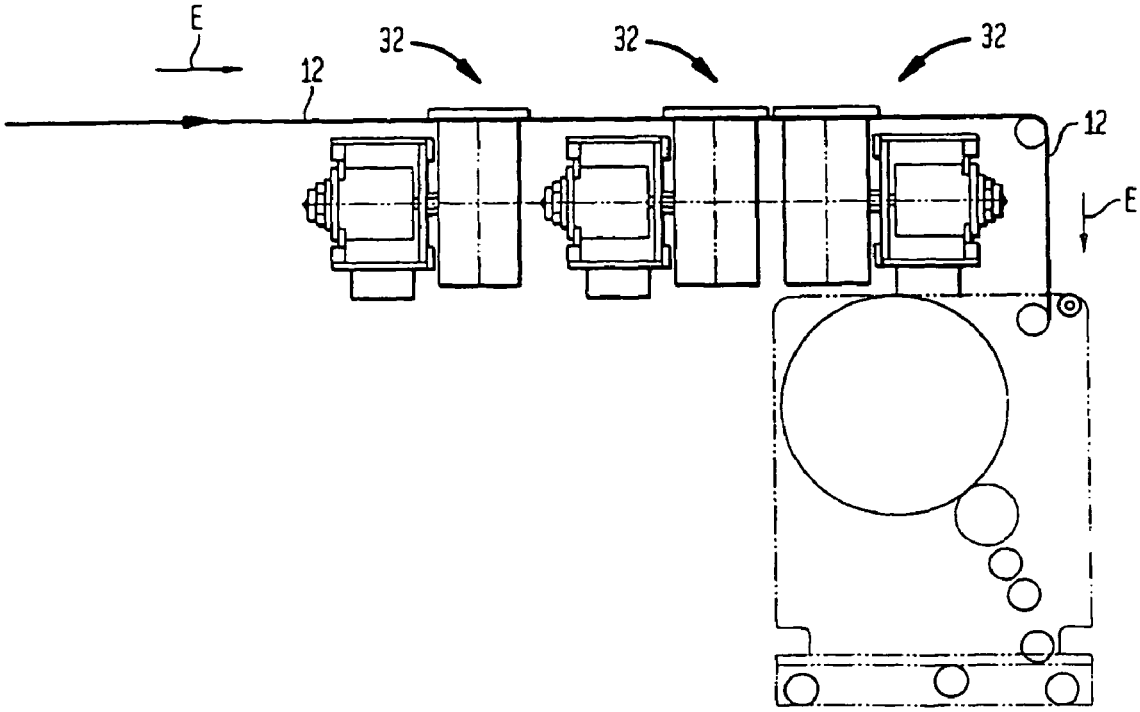
FIG. 7 is an end view of a plurality of printing presses of the present invention operative to print multi-colors onto a web.

In FIG. 7, there is shown an end view of a plurality of flexographic printing presses 32 constructed in accordance with the present invention. As shown, the plurality of flexographic printing presses 32 are located serially and close to each other such that the web 12 can travel from one flexographic printing press 32 to a subsequent flexographic printing press 32 without the need for idler rollers or any change of direction. Instead, the web 12 can travel in a generally straight line direction such that the introduction of stress is minimized and yet, each different flexographic printing press 32 can lay down a different color accurately and with precise registration.

It will be understood that the scope of the invention is not limited to the particular embodiment disclosed herein, by way of example, but only by the scope of the appended claims.

What is claimed is:

1. A method of printing, comprising:

printing indicia on a web from a print drum that is in line contact with the web while the web is stopped from advancing in a direction of travel as the print drum moves in a direction that is transverse to the direction of travel of the web and rolls along a surface of the web to effectuate the line contact.

2. A method of claim 1, further comprising sandwiching the web between the printing drum and a flat platen.

3. A method of claim 1, wherein the print drum includes an external surface and a printing plate affixed to the external surface, further comprising inking the printing plate, the printing plate having the indicial to be printed.

4. A method of claim 3, further comprising coordinating the inking of the printing plate with the moving and the rolling of the print drum.

5. An apparatus to effect printing, comprising:

a print drum arranged in line contact with a web to print indicial on the web while the web is stopped from advancing in a direction of travel as the print drum moves in a direction transverse to the direction of travel of the web and rolls along a surface of the web to effectuate the line contact.

6. An apparatus of claim 5, further comprising a flat platen arranged so that the web is sandwiched between the flat platen and the and print drum.

7. An apparatus of claim 5, wherein the print drum includes an external surface and a print plate affixed to the external surface, the print plate being inked and having the indicia to be printed on the web.

8. An apparatus of claim 7, further comprising an ink applicator arranged to effect inking of the print plate in coordination with transverse and rolling movement of the print drum along the surface of the web.

* * * * *